US008196372B2

(12) United States Patent
Perl et al.

(10) Patent No.: US 8,196,372 B2
(45) Date of Patent: Jun. 12, 2012

(54) PACK OF SEVERAL CONTAINERS AND METHOD FOR THE PRODUCTION OF THE PACK

(75) Inventors: Kurt Perl, Rimsting (DE); Michael Hartl, Raubling (DE)

(73) Assignee: Krones AG, Neutraubling (DE)

( * ) Notice: Subject to any disclaimer, the term of this patent is extended or adjusted under 35 U.S.C. 154(b) by 0 days.

(21) Appl. No.: 12/924,173

(22) Filed: Sep. 22, 2010

(65) Prior Publication Data

US 2011/0073511 A1 Mar. 31, 2011

(30) Foreign Application Priority Data

Sep. 29, 2009 (DE) ..... 10 2009 044 132
Nov. 13, 2009 (DE) ..... 10 2009 044 519

(51) Int. Cl.
*B65B 13/02* (2006.01)

(52) U.S. Cl. ..... 53/399; 53/588; 206/150

(58) Field of Classification Search ..... 53/399, 53/398, 397, 582, 588, 589, 590, 591; 206/150, 206/159, 160, 428
See application file for complete search history.

(56) References Cited

U.S. PATENT DOCUMENTS

| | | | | |
|---|---|---|---|---|
| 2,885,839 | A * | 5/1959 | Weiss | 53/398 |
| 3,023,554 | A * | 3/1962 | Hlavacek et al. | 53/399 |
| 3,084,792 | A * | 4/1963 | Poupitch | 206/150 |
| 3,930,578 | A | 1/1976 | Stein | 205/150 |
| 4,269,308 | A * | 5/1981 | Platt | 206/150 |
| 4,483,438 | A * | 11/1984 | Kobiella | 206/83.5 |
| 4,930,633 | A * | 6/1990 | Gloyer | 206/428 |
| 5,087,306 | A * | 2/1992 | Cheung et al. | 156/73.5 |
| 5,570,787 | A | 11/1996 | Danovaro et al. | 206/428 |
| 5,588,278 | A * | 12/1996 | Wynn et al. | 53/399 |
| 5,775,486 | A * | 7/1998 | Edqvist | 206/145 |
| 6,039,181 | A * | 3/2000 | Whiteside | 206/428 |
| 6,223,499 | B1 * | 5/2001 | Wilkey | 53/399 |
| 2007/0056248 | A1 * | 3/2007 | Duschek | 53/399 |
| 2007/0215506 | A1 | 9/2007 | Hartness et al. | 206/432 |

FOREIGN PATENT DOCUMENTS

| | | | |
|---|---|---|---|
| DE | 8515888 | U1 | 7/1985 |
| DE | 3804211 | A1 | 8/1989 |
| DE | 693 11 338 | T2 | 12/1997 |
| DE | 20 2006 000 215 | U1 | 3/2006 |
| DE | 20 2008 005 594 | U1 | 7/2008 |
| EP | 0 116 891 | | 8/1984 |
| EP | 0 392 996 | A1 | 10/1990 |
| EP | 1886921 | A1 | 2/2008 |
| GB | 22 81 731 | | 3/1995 |
| WO | WO 98/07635 | A1 | 2/1998 |
| WO | WO 99/67138 | A1 | 12/1999 |

OTHER PUBLICATIONS

EPO machine translation of DE 20 2008 005 591, 6 pages.
EPO machine translation of DE 8515888 U1.

* cited by examiner

*Primary Examiner* — Paul R Durand
(74) *Attorney, Agent, or Firm* — Davidson, Davidson & Kappel, LLC

(57) ABSTRACT

The invention relates to a pack, which includes at least two PET containers combined with each other, which are held together by a strip-like or ribbon-like strap, the strap being spun about an outer surface of the PET containers in a horizontal manner, wherein an inner surface of the strap, which lies at the outer surfaces of the PET containers, is fixed at least at one junction with one of the PET containers. The strap is fixed at the junction by a material integrated bond in the form of at least one welded joint.

15 Claims, 5 Drawing Sheets

PACK OF SEVERAL CONTAINERS AND METHOD FOR THE PRODUCTION OF THE PACK

This claims the benefit of German Patent Applications DE 10 2009 044 132.8, filed Sep. 29, 2009 and DE 10 2009 044 519.6, filed Nov. 13, 2009 both of which are hereby incorporated by reference herein.

The present invention relates to a pack, which comprises at least two PET containers combined with each other, which are held together by means of a strip-like or ribbon-like strapping means and said strapping means being spun about an outer surface of the PET containers in a horizontal manner, wherein an inner surface of the strapping means, which lies at the outer surfaces of the PET containers, is fixed at least at one junction with one of the PET containers.

BACKGROUND

Different possibilities regarding the combination of single articles to larger packs are already known. Thus, containers for beverages, for example, are combined and packed to packs of four, six or more containers mostly by means of shrink films. Mostly, the production of packs is necessary, since packs are the most frequent alternative of sales units for containers for beverages and bottles made of PET polymer. The packs are in parts combined once more for transport purposes and/or arranged in layers and palletized.

The shrink films used for the production of known packs are in need of certain production steps which on the other hand demand a relatively high need of energy. Besides, the used film causes production costs, costs for supply and for the handling as well as for later disposal, since said films are no longer needed after the sale. Likewise, the machinery equipment for the supply of the so called film wrapping modules and other handling stations causes high investment costs. Finally, the supply of the so called shrinking tunnel, wherein the film, which is being wrapped about the packs, is being shrinked about the bottles by means of hot air admission, also causes relatively major capital investment.

Furthermore, the containers can be held together and combined with each other to one pack by means of so called strapping strips. When using such strapping strips, however, a problem can arise in the fact that the packs do not remain rugged due to no definite allocation of the containers. The containers neither form a rugged longitudinal formation nor a diagonal formation of the packs after such a strapping. The reason is that the containers and hence the pack can be positioned from a longitudinal formation into a diagonal formation or vice versa by means of mechanic influence during the transport in further processing machines. Likewise, no higher tension of the strapping strips leads to the minimization of the shifting of the containers, since a rolling-off of the cylindrical containers against each other cannot be reliably avoided. A reason for this fact is, for example, that the containers, particularly the PET containers, are not dimensionally stable.

DE 20 2006 000 215 U1 discloses a pack which comprises products which are held together by a packing material. The packing material has two packing sections that stick together to strongly and firmly hold the products together. An adhesive strip is provided at one end of the packing material and spun about the products, wherein an overlap of the two ends is created. The package material sections formed thereof are fastened in an adhesive manner about the products by means of forces which hold said products together. It is proposed to provide an adhesive strip at an outer surface of a free end of the strip-like packaging material so that the free end of the packaging material is self-adhesive. In this embodiment of a pack, the containers can be shifted in their formation and do not remain rugged in the pack.

DE 693 11 338 T2 discloses a bundling-up device for container sets which comprises a membrane made of plastic material and is defined by a tubular band adapted to wrap and tighten a predetermined number of containers disposed in side by side relation, at side portions thereof, as well as a carrying handle for handling the unitary container set.

SUMMARY OF THE INVENTION

An object of the present invention is to provide a cost-saving and easy manageable possibility for the production of rugged packs which avoids at least partially the mentioned drawbacks of the prior art.

The present invention relates to a pack comprising at least two PET containers which are combined with each other and held together by means of a strip-like or ribbon-like strapping means, and said strapping means being spun about an outer surface of the PET containers in a horizontal manner. These strapping means are laid and afterwards fastened about the PET containers preferably during a continuous conveying process. The PET containers are normally not being stopped or deferred during the application of the strapping means, since the strapping means can be applied about the PET containers in a continuous process during the uninterrupted conveyance of said PET containers.

According to the invention, an inner surface of the strapping means, which lies at the outer surfaces of the PET containers, is firmly fixed at least at one junction with one of the PET containers. The invention is characterized in that the strapping means is fixed at the junction by means of a material integrated bond in the form of at least one welded joint. The PET containers in the pack cannot be shifted by means of such a junction, so that a defined packaging order is maintained.

The welded joint can be a sonic weld joint or a laser weld joint, for example, or another suitable joining technique. As for thermoplastic and thermoplastic polymer respectively the material is melted on or at least softened at the desired weld by means of supply of heat, in order to enable a material integrated bond at the junction to be welded. As for ultrasonic welding the polymers are connected together by means of mechanical vibrations. The main feature of this method is that the heat necessary for welding between the components is developed by molecular friction and surface friction in the components.

The strapping means is at least one flat strip which is spun about the outer surfaces of the PET containers and afterwards connected on its ends in a pre-stressed manner. The PET containers are combined and held together with said spun strip-like or ribbon-like strapping means so that they can be transported safely. Two or more parallely running strips can be the strapping means, of course. Thus, the strapping means is one, two, or more similar or different strips made of polymer or a composite material, wherein the strips are connected with each other on its ends by means of gluing, welding, cramping, knotting or else and in each case in an overlapping manner. An advantageous embodiment can be a welding of the overlapping ends of the strapping means. Besides it is possible that said ends are welded on at least one PET container of the pack by means of one weld point, so that the PET containers are secured in their formation during transport. Thus, the containers of the pack cannot be shifted in different types of formation, such as from a longitudinal formation into a diagonal formation, for instance.

Here it needs to be added that the pack can consist of two or more, preferably, however, at least three PET containers, since the mentioned problem of shifted containers against each other occurs as recently as with packs of at least three containers combined with each other. As for a preferred alternative of the pack according to the invention, at least one weld point is added as a point of fixation on a middle PET container and/or on a further oppositely arranged PET container. Possible is also that a weld point can be provided on a PET container, wherein said container is the most external of several containers of the pack, which can be also referred to as a so called container situated in the corner.

As for a pack whereby the PET containers are arranged in a diagonal formation, it would be also possible that a first point of fixation would be attached on a middle PET container, and a second point of fixation would be attached on a PET container arranged diagonally opposite. With such an alternative, the pack would not be shifted into a longitudinal formation, since the strapping means is fixed at the PET containers by means of a weld point and thus no shifting of the containers would take place. The strapping means should be preferably fastened with at least one point of fixation at the PET containers arranged to a pack. With two points of fixation it would make sense to arrange said two points of fixation at the PET containers arranged opposite of each other.

The PET containers held together to form a pack can be provided in each case with notches and said notches circulating in an annular form and/or extending in an horizontal direction for receiving and/or fixing of the strapping means, if necessary. With such a strapping means, an additional fixation of the strapping means can be provided, since the applied strapping means are thus fixed in their horizontal position. Furthermore, the PET containers held together to form a pack are in each case provided with a container neck underneath a top-side orifice, wherein a further strapping means for fixing the PET containers can be provided on said container neck. Each of these mentioned alternatives of strapping means is additionally provided with at least one weld point on at least one PET container of the pack so that the drawbacks of prior art are remedied.

A recyclable material as a strapping means is particularly advantageous, wherein said recyclable material consists of pure thermoplastic polymer, for example. Biologically degradable material is also possible for usage, if necessary, wherein said biologically degradable material can also be used as composite material.

A further advantage of the invention contrary to known alternatives from the prior art are amongst other things that the strapping strips are less expensive with regard to production than a film. Said strapping strips can also be easier processed than a film. No shrinking tunnel is necessary, which results in high energy saving and a reduction of the investment costs.

The PET containers arranged to form a pack are provided with container inner surfaces which abut with each other in a pack arrangement. Said container inner surfaces of the PET containers can be glued together at their junctions. That would result in the fact that the container inner surfaces abutting against each other would be provided in each case with at least one glue dot or with at least a double-faced adhesive tape. This glue is possible with packs which are arranged in a longitudinal formation or in a diagonal formation. Instead of the glue, also a material integrated bond of the abutting container inner surfaces would be possible. Thus, one point of fixation in the form of a weld point could in each case be at least provided at the abutting container inner surfaces. With such aforesaid alternatives it would be possible that the PET containers are held together via so called internal points of fixation so that a strapping means would be no longer necessary in the bottom region of the pack. However, a further fixation in the form of a strapping means or a strip in a notch and a recessed grip respectively of the PET containers should be carried out. It is also possible that a further strapping means is applied on at least two diagonally arranged containers about the container neck.

As for a further stabilization of packs, wherein the PET containers are arranged in a diagonal formation, it would be possible that a first strapping means would run, for example, in the notch or in the recessed grip, and a second strapping means would run about at least two container necks of a shorter diagonal of the pack. The diagonal formation of a pack can be compared with a parallelogram which has two diagonals. On the one hand a shorter diagonal and on the other hand a longer diagonal. Such a strapping means, which runs about the shorter diagonal of the container necks, could also be additionally used as a carrier handle.

A further embodiment can provide for the possibility that a carrier handle is applied and fixed during or after the application of the strapping means at the outer surface of the pack and/or at the strapping means. Said carrier handle can contribute to an additional attitude stabilization of the pack formation so that the containers of beverages can only be slightly shifted against each other. The carrier handle forms a carrier handle which overlaps the pack on its top side, wherein said carrier handle is arranged and fixed at the outer surface of the pack and/or at the strapping means.

Furthermore, the invention relates to a method for the production of packs, which include at least two PET containers, and wherein said two PET containers are held together by means of a strip-like strapping means, and said strapping means being spun about an outer face of the PET containers in a horizontal manner. As already mentioned above, the strapping means is at least one flat strip which is connected on its ends in a pre-stressed manner, and wherein the strip is welded with one of the PET containers at least at a junction on an inner face pointing to the PET containers. The weld of the at least one strip is carried out during or directly after the strapping means of the at least two, preferable three or more PET containers.

Besides, the present invention at hand provides for a device for the production of packs with at least two PET containers combined with each other, which are held together by means of a strip-like strapping means, and said strapping means being spun about an outer face of the PET containers in a horizontal manner, wherein the device for the implementation of a method is arranged and provided.

Further features and advantages of the present invention shall now be described in greater detail according to the accompanying figures in the following detailed description. The dimensions of the individual elements to each other do not always correspond with the real dimensions since some forms are shown simplified and other forms are shown enlarged with respect to other elements for the sake of clarity.

DETAILED DESCRIPTION

Same elements refer to same reference numbers throughout the various figures. Furthermore, only reference numbers which are necessary for the description of the respective figure are shown in the various figures for the sake of clarity. The shown embodiments are only examples of how the method according to the invention can be designed and shall not be regarded as limiting the invention.

As for the pack and the sales unit respectively described in the following, several containers of beverages are combined with each other. The packs are formed by means of strapping means of the containers with strings, strips made of different material such as paper, polymer, metal, and rubber seal and so on, of rigid or flexible type. Generally, all thinkable geometric arrangements of the containers are possible with the type of connection which is referred to as container strapping means shown here: linear matrix arrangement in a n times m-arrangement of lines and columns for round or rectangular, cubic or other containers as well as, for example, spherical packing at an angle of approximately 30° and 60° degrees respectively with round containers in any number. The arrangement of the packs or containers depends on the feeding of the containers and their division by the so called container divider.

Figure 1A:
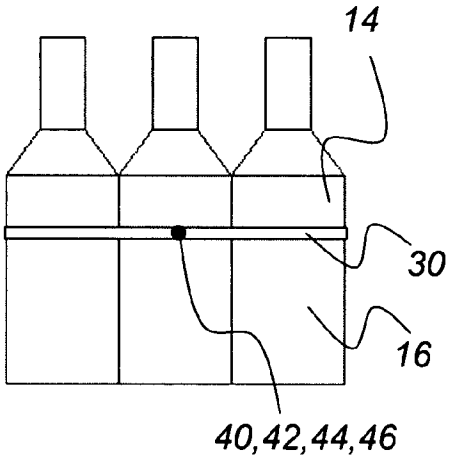
FIG. 1*a* to 1*d* show schematic views of a first alternative of a pack in different views.
Figure 1B:
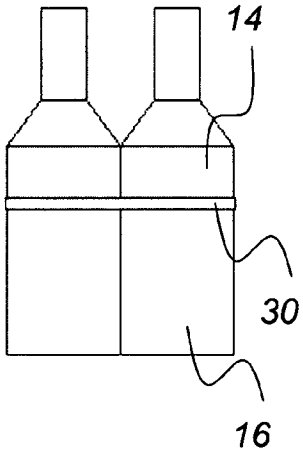
Figure 1C:
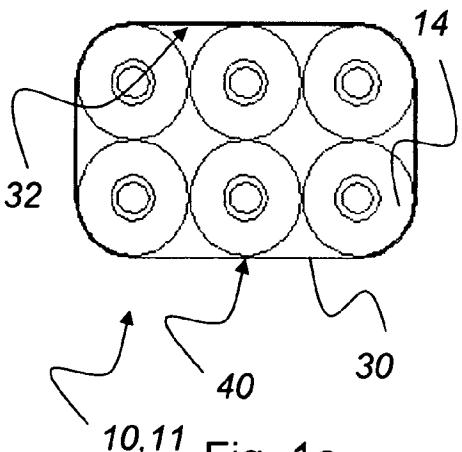
Figure 1D:
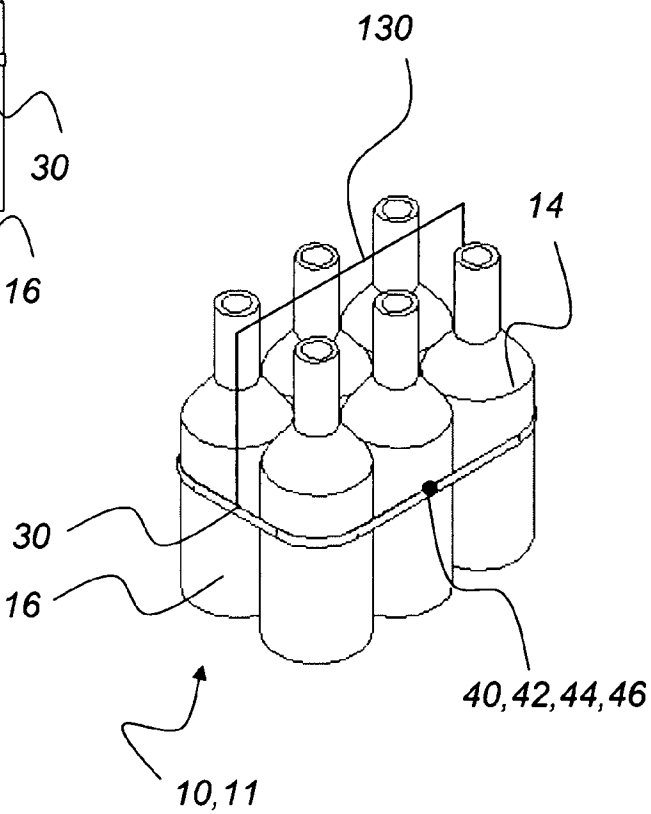
Figure 2A:
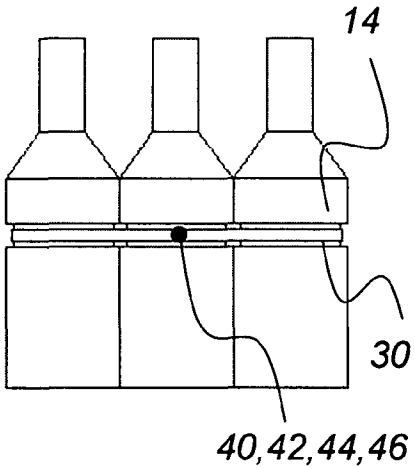
FIGS. 2*a* to 2*d* show schematic views of a second alternative of a pack in different views.
Figure 2B:
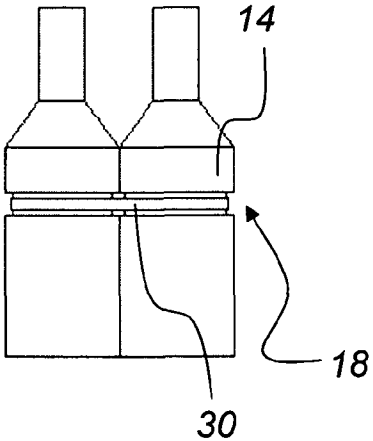
Figure 2C:
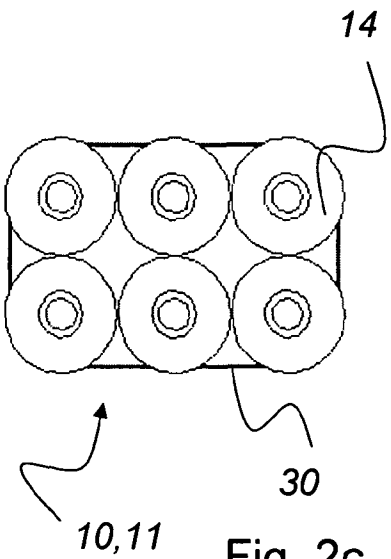
Figure 2D:
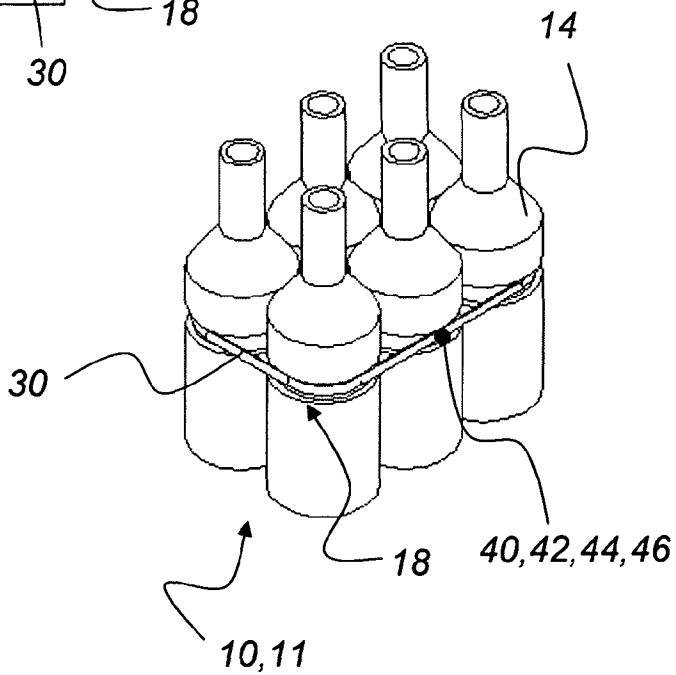
Figure 3A:
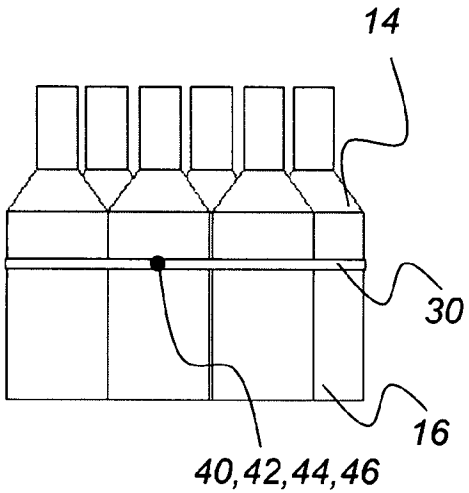
FIGS. 3*a* to 3*d* show schematic views of a third alternative of a pack in different views.
Figure 3B:
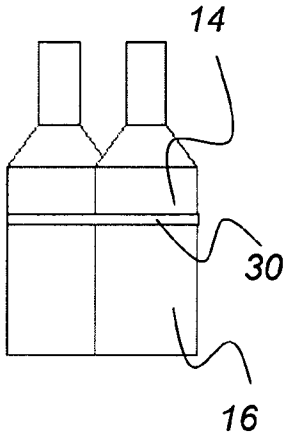
Figure 3C:
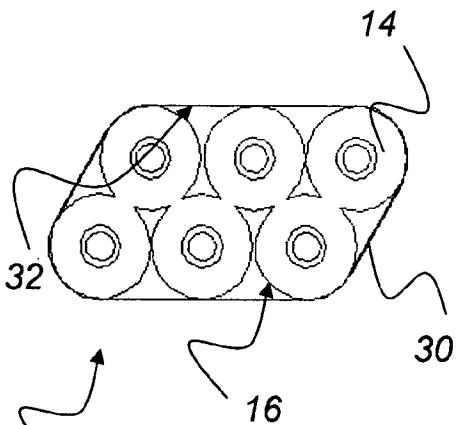
Figure 3D:
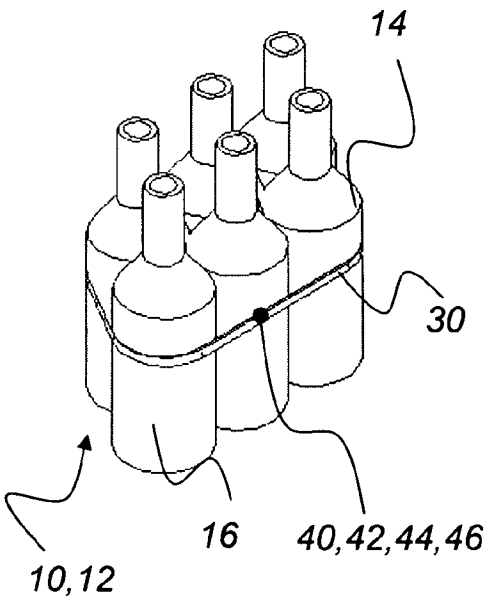
Figure 4A:
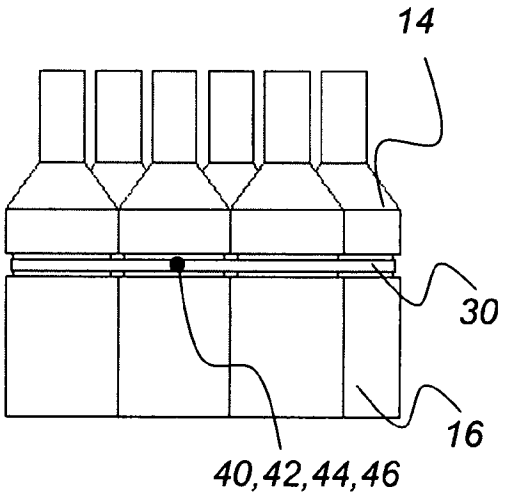
FIGS. 4*a* to 4*d* show schematic views of a fourth alternative of a pack in different views.
Figure 4B:
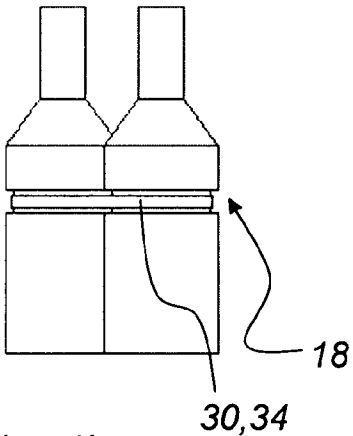
Figure 4C:
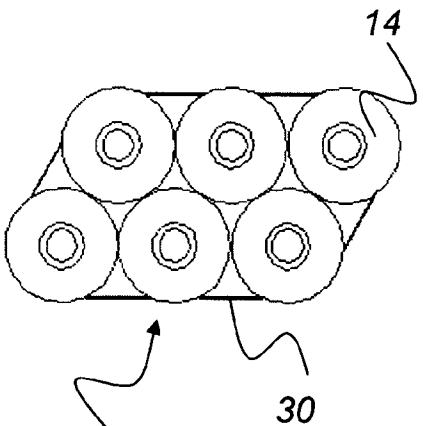
Figure 4D:
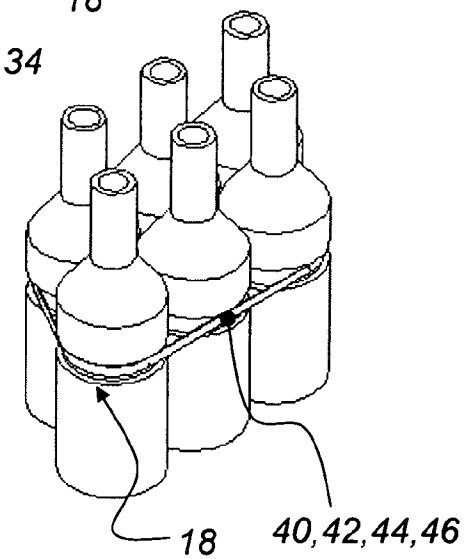

The FIGS. 1*a* to 1*d* show schematic views of a pack 10 in different views. All views of the FIGS. 1*a* to 1*d* show in each case a pack arrangement in the form of a pack 10, with which the containers 14 are arranged next to each other in a so called longitudinal formation 11. In the example at hand, the pack 10 consists of six PET containers 14 combined with each other, which are held together by means of a strip-like or ribbon-like strapping means 30, and said strapping means 30 being spun about an outer face 16 of the PET containers 14 in a horizontal manner. An inner face 32 of the strapping means 30, or strap, touching the outer faces 16 of the PET containers 14 forms at least one junction 40 with one of the PET containers 14 and is fixed there according to the invention at hand. The strapping means 30 is fixed at the junction 40 by means of a material integrated bond 42 in the form of at least a welded joint 44 and prevents by this fixation a shifting of the PET containers 14 in the pack 10. Thus, the pack 10 remains in its longitudinal formation 11. FIG. 1*d* also shows schematically a possible handle 130, attached in this case to strapping means 30.

The FIGS. 2*a* to 2*d* show different views of a pack 10, which has the PET containers 14 also arranged in a longitudinal formation 11, such as shown in FIGS. 1*a* to 1*d*. The PET containers 14 combined with each other to a pack 10 are in each case provided with notches 18 and said notches 18 circulating in an annular form and/or extending in an horizontal direction for receiving and/or fixing of the strapping means. Said notch 18 has a width which at least corresponds with the width of the strapping means 30 so that said strapping means 30 can be inserted into the notch 18. The notch 18 serves for further fixation of the PET containers 14 in the pack 10 and for an increasing stability of the pack 10.

Likewise, the inner face 32 of the strapping means 30 is situated in this embodiment at the outer faces 16 of the PET containers 14. The strapping means 30 is fixed at least at one junction 40 with a PET container 14. The strapping means 30 is fixed at this junction 40 by means of a material integrated bond 42 in the form of at least one welded joint 44 and prevents by this fixation a shifting of the PET containers 14 in the pack 10. Thus, the pack 10 remains in its longitudinal formation 11.

FIGS. 3*a* to 3*d* show a pack 10 in a diagonal formation 12, wherein said pack 10 likewise consists of PET containers 14. The pack 10 consists also in this embodiment of six PET containers 14 combined with each other, wherein said PET containers 14 are held together by means of a strip-like or ribbon-like strapping means 30, and said strapping means 30 being spun about an outer face 16 of the PET containers 14 in a horizontal manner, wherein an inner face 32 of the strapping means 30, which lies at the outer faces 16 of the PET containers 14, is fixed at least at one junction 40 with one of the PET containers Finally, FIGS. 4*a* to 4*d* show a pack 10, which likewise consists of PET containers 14 arranged in a diagonal formation 12. The PET containers 14 are likewise provided with a notch 18, such as shown in FIGS. 2*a* to 2*d*. The strapping means 30 can be lead in this notch 18.

Figure 5:
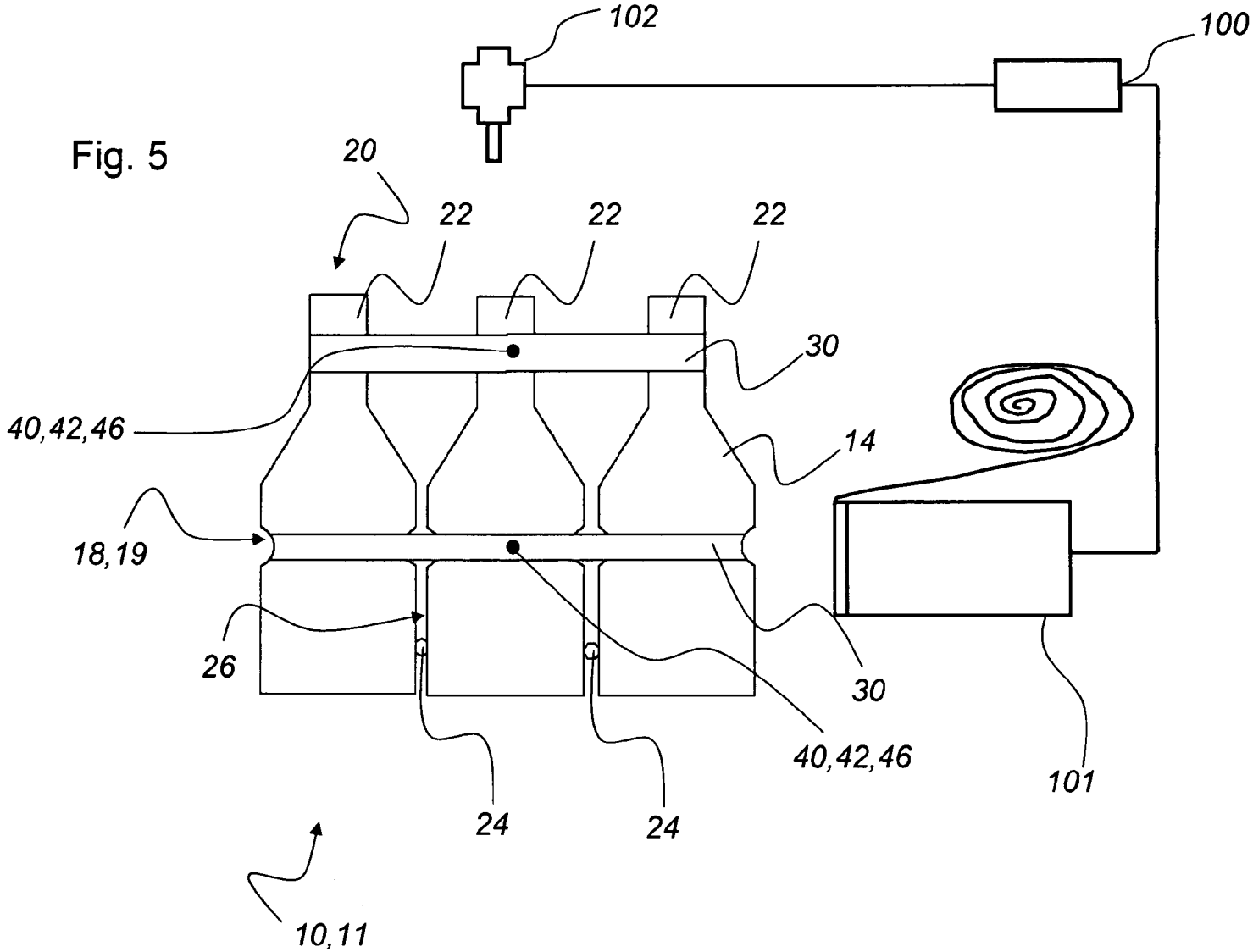
FIG. 5 shows a schematic view of a lateral view of a pack in longitudinal formation.

FIG. 5 shows the schematic view of a lateral view of a pack 10, wherein the PET containers 14 are arranged in a longitudinal formation 11. The PET containers 14 are fixed together at the inner faces of the containers 26 by means of glue dots 24, so that a strapping means is no longer needed on the bottom side of the PET containers 14. Furthermore, a strapping means 30 is spun about the notch 18 or a so called recessed grip 19 of the PET containers 14. Said strapping means 30 is provided with a weld point 46 on at least one junction 40 between the strapping means 30 and a PET container 14. This bond 42 can be applied, for example, on a PET container 14 arranged oppositely.

The PET containers 14 combined with each other to form a pack 10 are in each case provided with a container neck 22 underneath of a top-side orifice 20, wherein a further strapping means 30 for fixing the PET containers can be arranged at said container neck 22. Likewise, this strapping means alternative is provided in addition with at least one weld point 46 at least at one junction 40 between the strapping means 30 and a PET container 14 of the pack 10.

A shifting of the pack 10 is prevented by means of glue dots 24, which are arranged at the inner faces of the container 26 of the PET containers 14, that is that the pack 10 remains rugged, for instance, in its longitudinal formation 11. These glue dots 24 can of course also be provided with packs 10, which have a diagonal formation 12 (please see FIG. 4).

A further embodiment of the invention, which is not shown here, can provide for the fact that the PET containers combined with each other to form a pack are in each case provided with a container neck underneath a top-side orifice, where a further strapping means can be arranged for fixing the PET containers.

In addition, at least one weld point 46 is provided with each of the above-mentioned strapping means alternatives at least at one junction 40 between the strapping means 30 and one of the PET containers 14 of the pack 10.

The material integrated bond 42 must not necessarily be provided at the middle PET container 15. It is also possible that the welded joint 44 is provided at a so called container situated in the corner.

FIG. 5 also shows solely schematically a device for providing straps 30, which may include a strap delivery device 101, for example delivering straps 30 one after another, or with two straps at the same time as the packs move on a conveyor, and a weld robot or other device 102 for providing welds 46. Controller 100 can control delivery of the straps via strap delivery device 101 and welding via weld device 102.

The invention has been described with reference to preferred embodiments. To the person skilled in the art it is also conceivable, however, to make changes and modifications to the invention without leaving the scope of protection of the appended claims.

LIST OF REFERENCE NUMBERS

10 pack
11 longitudinal formation
12 diagonal formation
14 PET container
15 middle PET container
16 outer face
18 notch
19 recessed grip
20 top-side orifice
22 bottle neck
24 glue dots
26 inner face of the container
30 strapping means
32 inner face
40 Junction
42 Bond
44 welded joint
46 weld point
100 controller
101 strap delivery device
102 weld device
130 handle

What is claimed is:

1. A method for the production of packs including at least two polyethylene terephthalate (PET) containers, the at least two PET containers are held together by a strap, comprising:

spinning the strap about an outer surface of the PET containers in a horizontal manner, the strap being at least one flat strip connected at ends of the strip in a prestressed manner; and welding the strip to at least one of the PET containers to form a weld joint at a junction of an inner surface of the at least one strip pointing to the PET containers and the at least one PET container.

2. The method as recited in claim 1 wherein the welding of the at least one strip is carried out during or directly after the strapping of the at least two PET containers.

3. The method as recited in claim 1 wherein the welding is a sonic welding or laser welding.

4. The method as recited in claim 1 further comprising connecting the ends in the prestressed manner by gluing, welding, cramping or knotting and in each case in an overlapping manner or by a stack formation.

5. The method as recited in claim 1 wherein the pack includes at least three PET containers and wherein the welding includes welding the at least one welded joint as a point of fixation on a middle PET container and/or on a further PET container arranged opposite the middle PET container.

6. The method as recited in claim 1 further comprising providing notches on the PET containers, the notches circulating in an annular form and/or extending in an horizontal direction for receiving and/or fixing of the strap.

7. The method as recited in claim 1 further comprising providing the PET containers with a container neck underneath a top-side orifice, and further comprising providing a further strap for fixing the PET containers on the container necks.

8. The method as recited in claim 1 further comprising providing a carrier handle overlapping the pack at a top side and fixed at the outer surface of the pack and/or at the strap.

9. A pack comprising:

at least two polyethylene terephthalate (PET) containers;

a strap, the at least two PET containers being held together by the strap, the strap being spun about outer surfaces of the PET containers in a horizontal manner, the strap being at least one flat strip connected at ends of the strip in a pre-stressed manner; and a welded joint at a junction of an inner surface of the strip pointing to the PET containers and at least one of the PET containers, the welded joint forming a material integrated bond.

10. The pack as recited in claim 9 wherein the welded joint is a sonic weld joint or a laser weld joint.

11. The pack as recited in claim 9 wherein the at least one flat strip is connected at the ends by gluing, welding, cramping or knotting and in each case in an overlapping manner or by a stack formation.

12. The pack as recited in claim 9 wherein the pack includes at least three PET containers and wherein the at least one welded joint is added as a point of fixation on a middle PET container and/or on a further PET container arranged opposite the middle PET container.

13. The pack as recited in claim 9 wherein the PET containers are provided in each case with notches, the notches circulating in an annular form and/or extending in an horizontal direction for receiving and/or fixing of the strap.

14. The pack as recited in claim 9 wherein the PET containers are in each case provided with a container neck underneath a top-side orifice, and further comprising a further strap for fixing the PET containers on the container necks.

15. The pack as recited in claim 9 further comprising a carrier handle overlapping the pack at a top side and fixed at the outer surface of the pack and/or at the strap.

* * * * *